United States Patent [19]

Olson

[11] Patent Number: 4,703,168

[45] Date of Patent: Oct. 27, 1987

[54] MULTIPLEXED WEDGE ANODE DETECTOR

[75] Inventor: Gaylord Olson, Plainsboro, N.J.

[73] Assignee: Princeton Applied Research Corporation, Princeton, N.J.

[21] Appl. No.: 757,178

[22] Filed: Jul. 22, 1985

[51] Int. Cl.[4] ..... H01J 40/14

[52] U.S. Cl. ..... 250/207; 250/208; 250/578

[58] Field of Search ..... 250/208, 209, 578, 207, 250/211 R, 211 J; 356/222

[56] References Cited

U.S. PATENT DOCUMENTS

| | | | |
|---|---|---|---|
| 2,963,390 | 12/1960 | Dickson, Jr. | 148/189 |
| 3,803,416 | 4/1974 | Strauss | 250/370 |
| 3,934,143 | 1/1976 | Prag | 250/211 J |
| 4,218,623 | 8/1980 | Utagawa | 250/578 |
| 4,377,747 | 3/1983 | Smith | 250/370 |
| 4,419,578 | 12/1983 | Kress | 250/390 |
| 4,469,945 | 9/1984 | Hoeberechts et al. | 250/370 |
| 4,559,639 | 12/1985 | Grover et al. | 378/19 |

OTHER PUBLICATIONS

American Institute of Physics, Rev. Sci. Instrum., pp. 1067–1074, vol. 52, No. 7 (Jul. 1981).

R. Wick, "Grabbing Images at Very Low Light Levels," Photonics Spectra, pp. 133–136 (May 1985).

H. Tseng, J. Ambrose, M. Fattahi, "Evolution of the Solid-State Image Sensor," Journal of Imaging Science, vol. 29, No. 1, pp. 1–7 (Jan./Feb. 1985).

J. Wiza, "Microchannel Plate Detectors," *Nuclear Instruments and Methods,* vol. 152, pp. 587–601 (1979).

A. Broadfoot and B. Sandel, "Self-Scanned Anode Arrat with Microchannel Plate Electron Multiplier: the SSANACON," Applied Optics, pp. 1533–1538, vol. 16, No. 6 (Jun. 1977).

C. Martin, P. Jelinsky, M. Lampton, R. Malina and H. Anger, "Wedge-and-Strip Anodes for Centroid-Finding Position-Sensitive Photon and Particle Detectors".

*Primary Examiner*—Edward P. Westin
*Assistant Examiner*—Charles F. Wieland
*Attorney, Agent, or Firm*—Finnegan, Henderson, Farabow, Garrett & Dunner

[57] ABSTRACT

A two-dimensional energy position detector includes an array of wedge-shaped anodes arranged in an alternating sequence. Each of the anodes is connected to a multiplexer which is controlled by a sequencer to place the signals from the anodes in a predetermined sequence onto a multiplex output line. A data processor may then analyze the signal on the multiplex output line to determine the position of energy incident on the anodes.

13 Claims, 5 Drawing Figures

MULTIPLEXED WEDGE ANODE DETECTOR

BACKGROUND OF THE INVENTION

The present invention relates to the field of imaging or position sensitive detectors and, in particular, to two-dimensional detectors used with microchannel plates.

Microchannel plates are often used for image amplification or intensification. FIGS. 1A and 1B are plane and cross-sectional views, respectively, of one such microchannel plate 10. Microchannel plate 10 includes a structure 15, which is typically leaded glass. Structure 15 has a metallic coating on both surfaces 17 and 18, and a high voltage is placed across the two surfaces when the plate is in operation. Piercing glass 15 is a two-dimensional array of a plurality of channels, typically 10,000 to 10,000,000, arranged in some type of regular matrix. For simplicity, FIGS. 1A and 1B show much fewer channels.

Each channel in FIGS. 1A and 1B is an electron multiplier which receives electrons at its inputs, but the inputs to the plates could also be protons, ions, photons or other similar particles or events. The diameters of the microchannels are on the order of tens of microns, and the channels themselves are usually biased at some slight angle with respect to surfaces 17 and 18. The angle in FIG. 1B is approximately 8° .

Of course, FIGS. 1A and 1B show only one type of microchannel plate. There are many other configurations, for example a chevron configuration. The following description is not limited to the particular configuration shown in FIGS. 1A and 1B.

The operation of microchannel plates is well known. Very simply, electrons enter one end of a channel, strike the sides of that channel and dislodge other electrons. The dislodged electrons in turn dislodge additional electrons so that eventually many electrons leave the channel in response to each electron that enters. A typical multiplication factor for microchannel plates is between 10,000 and 10,000,000. Additional details regarding the construction and operation of microchannel plates can be found in J. Wiza, "Microchannel Plate Detectors," Nuclear Instruments and Methods 587, Vol. 162 (1979), which is incorporated herein by reference.

As previously indicated, microchannel plates are often used in image intensification devices to amplify image data either for display, for example on a phosphor screen, or for later data processing. Image intensification has important military uses, such as for night vision devices and for optical sensing in spacecraft. Image intensification devices for military uses must be able to locate objects with great speed and accuracy. For spacecraft applications, such devices need great accuracy with relatively simple circuit configuration to reduce power consumption. The speed and accuracy of such an image intensification device depends not only on the microchannel plate configuration, but also on certain characteristics of the detector, which captures and measures the output of microchannel plates, and the electronics coupled to the detector.

The anode detectors, or anodes for short, measure the number of electrons which leave the microchannel plate detector and strike the anodes. The electrons incident on a metal anode create an electric potential, usually a pulse, whose change in voltage, V, corresponds to the number of electrons incident on an anode. The voltage change may be determined by:

$$V = Q/C_{anode}$$

where $Q = 1.6 \times 10^{-19}$ (Coulomb/electron) x number of electrons, and $C_{anode}$ is the capacitance of the anode.

Several different types of anode detectors have been used in the past in both military and space applications. Generally, all the anode detectors are used to discriminate incoming energy, for example, optical or ionizing radiation.

The SSANACON method, which stands for Self Scanned Anode Array Image Converter is described in A. Broadfoot and B. Sandel, "Self-Scanned Anode Array with a Microchannel Plate Electron Multiplier: the SSANACON," Applied Optics pp. 1533–38, Vol. 16, No. 6 (June 1977), which is incorporated herein by reference. The device described in that article contains an anode array with one hundred and twenty-eight (128) 3 mm long rectangular anodes aligned in parallel on 100 um centers. The anodes were mounted to receive the outputs from microchannels at 20 um centers. The anodes are alternately connected by FET shift register control switches to one of two video lines denoted even and odd. Photoevent counting with this device uses a fast interrogation of the anode array: a clock frequency of 200 kHz or an anode sampling rate of 3 kHz.

One problem with the SSANACON is that it can discriminate in one direction only, that direction being along the axis of the 128-anode array. Furthermore, the shift register data collection arrangement coupled to the anodes lacks flexibility, thus limiting the modes of accessing or processing the anodes.

A different method of detection using microchannel plates, which does allow two-dimensional discrimination, is discussed in C. Martin, P. Jelinsky, M. Lampton, R. Malina, and H. Anger, "Wedge-and-Strip Anodes for Centroid-Finding Position Sensitive Photon and Particle Detectors," American Institute of Physics, Rev. Sci. Instrum., pp. 1067–1074, Vol. 52, No. 7 (July 1981), which is also incorporated herein by reference. The wedge-and-strip method described in this publication uses an array of alternating wedge shaped and strip anodes. The width of the wedge-shaped anodes varies linearly in a direction perpendicular to the axis of the anode array (i.e., is triangular). The strips are rectangular and have different widths. All the anodes are coupled to signal processing electronics which computes values for the location of the centroid of the incident energy in the X and Y directions. The strips are used to determine centroid position along the Y or array axis, and the wedges are used to detect the centroid position in the X axis, which is the axis perpendicular to the array axis.

One disadvantage of the wedge and-strip anodes is that the processing electronics connected to the anodes is relatively complex and becomes more so as the number of anodes increases. The electronics also provides no flexibility for processing. In addition, since the anodes are relatively large, they have a high capacitance and therefore a poor signal-to noise ratio.

A slightly different version of the wedge-and-strip anode is shown in Praq, U.S. Pat. No. 3,934,143, which shows a number of alternatinq right-triangular electrodes in an ionizing radiation detector. The electrodes extend along the upper surface of a plate which has a common electrode covering substantially the entire surface of the other side of the plate. The triangular electrodes are of p-conductive silicon and are separated by small slices of silicon dioxide. Each electrode is coupled to several special purpose adders, multipliers, and other special purpose circuitry to calculate the position in the X and Y axis of the centroid of the incident energy. The disadvantages of this device, however, are generally the same as with the wedge and strip device and method, except the anodes in Praq do not appear to be as large as those in wedge-and strip device.

One object of this invention is an accurate and fast two-dimensional position detector for use with a microchannel plate.

Another object of this invention is a microchannel plate position detector which is flexible enough to accommodate different numbers and orientations of anodes, as well as different sequences for scanning the anodes, without requiring substantial added circuitry, cost, or complexity.

Additional objects and advantages of this invention are set forth in part in the description which follows and in part are obvious from that description or may be learned by practice of the invention. The objects and advantages of the invention may be realized and obtained by the methods and apparatus particularly pointed out in the appended claims.

SUMMARY OF THE INVENTION

The present invention overcomes the problems of the conventional devices and achieves the objects listed above by using wedge-shaped anodes which are connected to a multiplexer.

More specifically, the apparatus for image detection of this invention comprises a plurality of wedge-shaped anode detectors, each detector including a base portion and a vertex portion and the anodes being arranged along a first axis in an alternating sequence such that, except for the detectors at the ends of the sequence, the vertex portion of any of the detectors is adjacent to the base portions of the two adjacent detectors. The wedge-shaped anode detectors also each include a connection link for presenting a detection signal representing the amount of the incident energy on the corresponding detectors. The apparatus also includes means coupled to each of the detector connection links, for multiplexing the detection signals at the output terminals onto a multiplex output line; and sequencing means coupled to the multiplexing means for controlling the multiplexing means to present at the multiplex output line a data signal containing a predetermined sequence of detection signals from selected ones of the detectors, the data signal containing information about the position of the incident energy.

The accompanying drawings, which are incorporated in and which constitute a part of this specification, illustrate one embodiment of the invention and, together with the description, explain the principles of the invention.

DESCRIPTION OF THE PREFERRED EMBODIMENT

The following description refers to a preferred embodiment of this invention which is illustrated in the accompanying figures.

Figure 2:
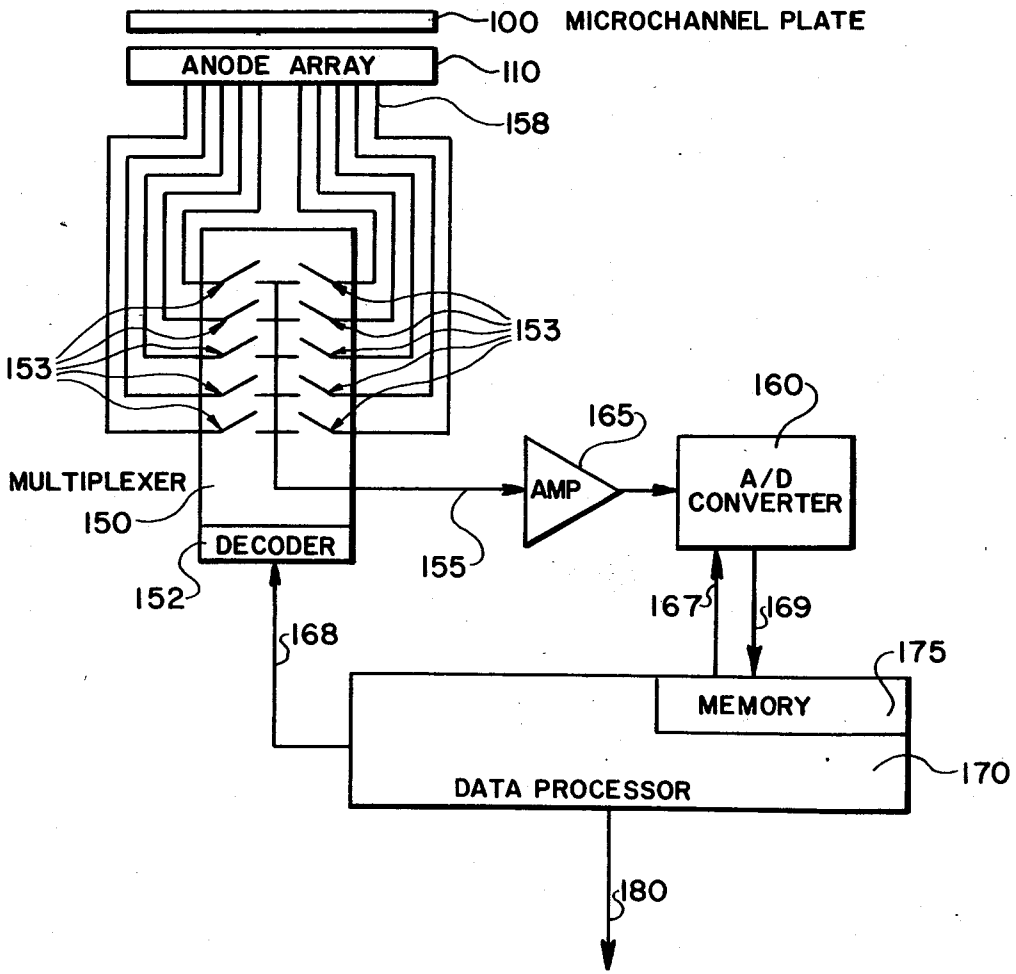
FIG. 2 shows an embodiment of a two-dimensional image detector according to this invention.

The image detector system in FIG. 2 comprises microchannel plate 100 and anode array 110 placed parallel to, and in close proximity with, plate 100. Outputs from the anodes in array 110 are coupled to the inputs of analog multiplexer 150 via output lines 158.

The output of multiplexer 150 feeds multiplex output line 155 which is the input to A/D converter 160 via amplifier 165. The output of A/D converter 160 is connected to data processor 170 via data line 169. Data processor 170 sends control signals to converter 160 via conversion control line 167 and also sends control signals to multiplexer 150 using multiplex control signal line 168.

Figure 1A:
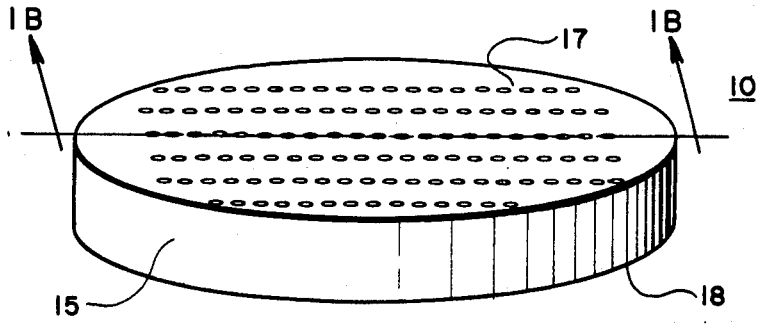
FIGS. 1A and 1B are plan and cut-away views, respectively, of a microchannel plate which can be used with this invention.
Figure 1B:
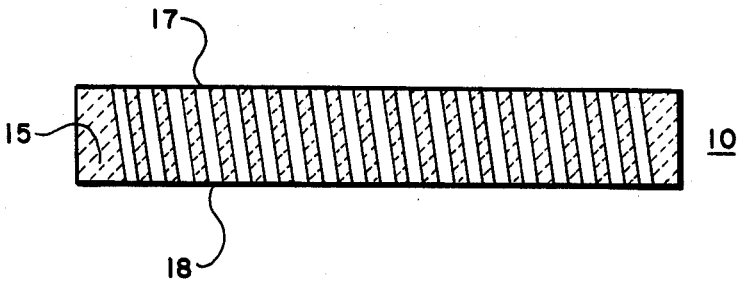
Figure 3:
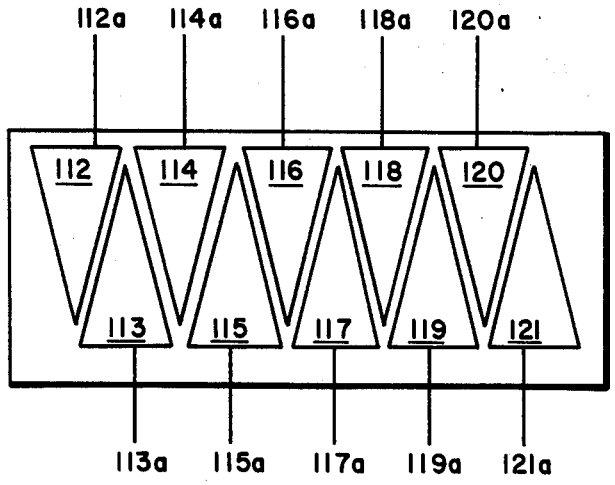
FIG. 3 shows a top view of the anode array in the system of FIG. 2.

Anode array 110 is shown in greater detail in FIG. 3. The array comprises a plurality of wedge shaped anode detectors 112–121. The anodes are preferably aluminum on a silicon substrate, and are manufactured using standard integrated circuit techniques. The anodes, however, can also be of any suitable conducting or semiconducting materials. Although only ten such anode detectors are shown, in reality, many more would probably be used in most applications for greater accuracy of image detection since the accuracy of detection is directly related to the number and size of the anodes. A typical array would include 200 to 2000 anodes.

In the embodiment shown in FIG. 3, each wedge-shaped anode contains a vertex portion, which is where the anode is narrowest, and a base portion at the other end of the anode where the anode is at its widest. A typical anode has about a 50 um width (i.e., base portion width) and a length of about 5 mm.

Each anode has an axis which runs perpendicularly from the base portion to the vertex portion. The width of the wedge-shaped anode of this invention increases as one approaches the base portion. Preferably, the wedge-shaped anode of this invention has a width which increases linearly as one moves along the anode axis from the vertex to the base portion. The wedge-shaped anodes in FIG. 3 are isosceles triangles, but they could as well be right triangles or, any other triangular shape.

Other wedge shapes are also possible, for example, those not having a point for the vertex or whose width does not increase linearly. A wedge-shaped anode, according to this invention, has a width measured perpendicular to the anode axis that increases as one proceeds from the vertex portion toward the base portion. One advantage of the triangular anode is the ease in certain signal processing.

As FIG. 3 demonstrates, the anodes are arranged along an axis perpendicular to each anode axis. In the preferred embodiment, the wedge shaped anodes alternate such that, except for the end anodes 112 and 121, the vertex portion of any other anode is adjacent to the base portions of the two adjacent anodes. Each anode is insulated from all the other anodes. Other arrangements are possible, but may make the later processing more difficult.

Each wedge-shaped anode also contains a connection link. In the preferred embodiment of anode array 110 shown in FIG. 3, the connection links **112*a*–121*a* are connected to the anodes 112–121**, respectively. As previously explained, the incident electrons create a voltage signal, called a detection signal, on the anodes. That signal appears at the connection links of the corresponding anodes. Those links thus each contain a signal, and those signals collectively contain information which identify the position, e.g., the centroid, of energy incident on the detector.

The distance between the anode arrays and the microchannel plates affects the size of the images, or "electron blurs" on the arrays. If the electron blur size is made small, a periodic positional error, or distortion, is introduced. This limits how close the anode array should be placed next to the microchannel plate. For larger electron blur sizes, the positional error is limited by the signal-to-noise ratio of the pulses produced from the anode array. Preferably, the distance between plate 100 and array 110 will be approximately in the range of 0.1–2 mm.

In accordance with the present invention, the apparatus also contains means, coupled to each of the anode detector connection links, for multiplexing the detection signals at those links onto a multiplex output line. In the preferred embodiment of the invention shown in FIG. 2, multiplexer 150 is coupled to connection links 112*a*–121*a* via lines 158. Analog switches 153 couple and uncouple the lines 158 to output line 155. Preferably, such switches are FET switches.

Preferably multiplexer 150 shares the substrate containing the anode array 110. This architecture reduces the capacitance on the input lines and increases the signal to noise ratio. The construction of multiplexer 150 uses well-known integrated circuit techniques. Consequently, lines 158 are preferably not a cable but rather integrated circuit connections, for example, via a metallization layer.

In operation, multiplexer 150 receives a multiplex control signal on line 168 to indicate which detection signal to place on the multiplex output line. Decoder 152 in multiplexer 150 decodes that signal into one of a plurality of switch signals, each of which controls a different switch in multiplexer 150.

By proper control of the multiplex control signal, one may obtain any desired sequence of detection signals on the multiplex output line. This feature affords the wedge anode detector of this invention great flexibility. Multiplexing the anode's signals by an integrated circuit multiplexer also makes the use of large anode arrays easier since the connections of the large number of anode detectors may be accomplished relatively easily using conventional integrated circuit technology.

The preferred embodiment of this invention also includes an analog-to-digital converter, shown as 160 in FIG. 2, coupled to the multiplex output line to convert the analog data on that output line into digital data. Such digital data can either be a multi-bit binary number representing the analog voltage level or simply be a "1" or "0" indicating whether the level on the multiplex output line does or does not exceed a predetermined threshold. In the latter case, the analog-to-digital converter would preferably be a basic comparator circuit of a well-known design. In the former case, the analog-to-digital converter 160 could also be a conventional A/D converter circuit having a bandwidth and accuracy which one of ordinary skill could select for the particular application.

Depending on the sizes of the anodes, the characteristics of the multiplexer and the sensitivity of the converter, an amplifier, shown as 165 in FIG. 2, may be needed between the multiplex output line and the input of the analog-to-digital converter. If an amplifier is needed, it can have a conventional operational amplifier configuration with a desired gain and bandwidth. It can also be a low noise, wide band charge-sensitive amplifier.

Analog-to-digital converter 160 may also be controlled by a conversion control signal 167 from data processor 170. The conversion control signal synchronizes converter 160 with data processor 170 to insure that the proper data is being converted at the proper time. Conversion control signal 167 could, for example, be a timing signal for sample and hold circuitry in converter 160.

Also in accordance with the present invention, there is provided sequencing means for controlling the multiplexer means to present on the multiplex output line a data signal containing a predetermined sequence of detection signals. In the preferred embodiment shown in FIG. 2, the sequencing means includes data processor 170 which is programmable to provide several different sequence control signals via a multiplex control line. Of course, such sequencing means need not be a full data processor but can include another circuit element which gives the necessary output signals, for example, a ROM.

Preferably, the sequencing means also includes means for processing the data signals on the multiplex output lines to perform image detection, e.g., to determine the centroids of the incident energy. In the preferred embodiment shown in FIG. 2, such processing means would be part of data processor 170.

When data processor 170 completes its calculations, it will output the necessary information via line 180. Line 180 could connect to a display or recording device, another processor, a communications link or any other element or system which can receive the information.

In the preferred mode of operation, the data signal would be read into memory 175 of processor 170 and stored in some type of recirculating or flip-flop buffer arrangement to assure no loss of data during processing. When processor 170 determines that it has sufficient amount of data to make the necessary calculations, it would perform image detection. For example, the processor could calculate the centroids of the incident energy from that data. One method for determining the location of the centroid in the Y axis, or the direction of the anodes' individual axes, is to total the energy received by the wedge-shaped anodes having their vertex at one end of the anode array, i.e., anodes 112, 114, 116, 118, and 120, and total the energy received by the anodes having their vertices at the other end of the anode array, i.e., anodes 113, 115, 117, 119, and 121, and then calculate the ratio of those totals. This calculation is the type of simplified signal processing which is available because of the triangular wedge-shaped anodes.

To determine the centroids of the incident energy along the X axis, i.e., in the direction of the anode array's axis, one could combine the energy received by adjacent pairs of wedge anodes. The centroid in the X axis would lie in the anode pair having the highest combined energy. Alternatively, one could, by software processing, locate the Gaussian distribution of energy from incident energy or use the method described in Column 7, lines 42–60 of Praq, U.S. Pat. No. 3,934,143 which is herein incorporated by reference.

In addition to its flexibility in configuration, the detecting apparatus of this invention also has a great deal of flexibility in mode of operation. For example, for small signals which have high resolution, e.g., when the light level is low and the photon inputs are random and separate in both space and time, a photon counting method is preferred. For higher signal levels in which a higher signal/noise ratio is desired within a short time, e.g., when so many photons strike the detector so quickly as to preclude identification of individual electrons, a charge integration method can be used.

In one example of a photon counting method, the A/D converter is actually a one-bit comparator. Data processor 170 sequentially polls the anodes so converter 160 can determine whether the energy of that anode exceeds a certain threshold. If so, then a "1" is added to the storage location in the memory 175 associated with that anode. If not, then the count in the associated member cell is not changed.

In an example of the charge integration method, the charges are allowed to accumulate on the anodes over a preset time period and then are measured and converted into binary numbers by a multi-bit analog-to-digital converter. Memory 175 stores those binary numbers for later processing.

Another embodiment of the apparatus of this invention uses a charge coupled device (CCD) shift register as the multiplexing means. One example of such a shift register is shown as FIG. 4. CCD register 200 includes shift elements 210*a* through 210*j*, each coupled to a different anode in the wedge anode array of this invention. In operation, a command from processor 170 over the control line causes the shift register elements to transfer the charges from the corresponding anode detectors. Then, a different command over that same control line causes the stored charges to shift sequentially throughout two lines of elements, each corresponding to a different side of the array, and out from elements 210*a* and 210*b* in FIG. 4. The timing is controlled by the clock input which can be supplied either from an externally supplied clock or from processor 170. Both the clock input and control lines are received by electronics box 220 which performs the necessary routing and decoding functions.

The technology of CCD shift registers is known to one of ordinary skill in the art. The details of such registers are shown, for example, in H. Tseng, J. Abrose, and M. Fattahi, "Evolution of the Solid-State Image Sensor," Journal of Imaging Science, Vol. 29, No. 1, pp. 1–7 (Jan./Feb. 1985) which is incorporated herein by reference.

Preferably, CCD shift register 200 is built into the wedge anode array substrate. One advantage of this architecture is that with the CCD shift register, the input capacitance is very low which allows for an improved signal-to-noise ratio.

Figure 4:
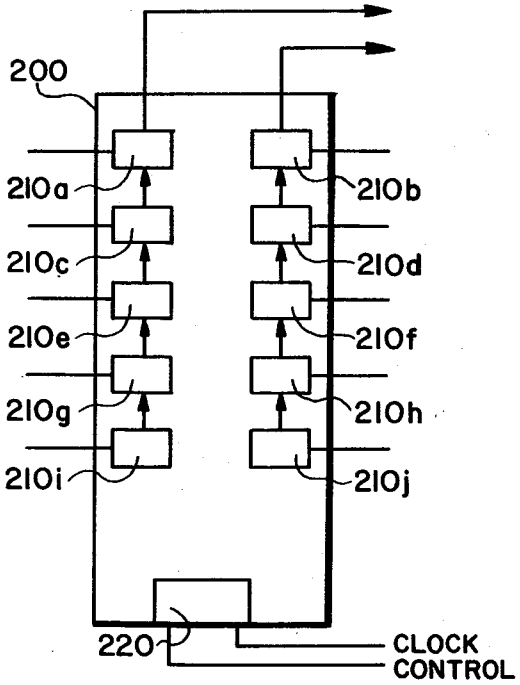
FIG. 4 shows a CCD shift register for use with the detector in FIG. 3.

The architecture shown in FIG. 4 is not the only possible architecture. For example, it is also possible for there to be one output video line from the CCD shift register containing signals from all the shift elements.

It will be apparent to those skilled in the art that modifications and variations can be made in the methods and apparatus of this invention. Certain modifications, for example to the anode arrays, the multiplexer and the analog-to-digital converter, have been described, but those modifications are not to be considered exhaustive. The invention in its broader aspects is therefore not limited to the specific details, representative apparatus, and illustrative examples shown and described. Departure may be made from such details without departing from the spirit or scope of the general inventive concept.

What is claimed is:

1. An apparatus for image detection comprising:

a plurality of wedge-shaped anode detectors, each detector including a base portion and a vertex portion and being arranged along a first axis in an alternating sequence such that, except for the detectors at the end of said sequence, the vertex portion of any of said detectors is adjacent to the base portions of the two adjacent detectors, said wedge-shaped anode detectors also each including an output terminal for presenting a detection signal representing the amount of said incident energy on the detector containing that terminal;

a multiplex output line;

means, coupled to each of said detector output terminals, for multiplexing said detection signals at said output terminals onto said multiplex output line; and sequencing means coupled to said multiplexing means for controlling said multiplexing means to present on said multiplex output line a data signal containing a predetermined sequence of said detection signals from selected ones of said detectors, said data signal containing image detection information.

2. The apparatus of claim 1 wherein said multiplexing means includes a decoder and a plurality of FET switches coupled to said decoder.

3. The apparatus of claim 1 wherein said multiplexinq means includes a CCD shift register.

4. The apparatus in claim 1 wherein said sequencing means also includes means for processing said data signal to determine the centroid of said incident energy in two dimensions.

5. The apparatus of claim 4 further including an analog-to-digital converter coupled between said multiplex output line and said processing means.

6. The apparatus of claim 5 wherein said analog-to-digital converter is a comparator circuit.

7. The apparatus of claim 5 wherein said analog-to-digital converter is a multi-bit analog-to-digital converter.

8. The apparatus of claim 5 further including an amplifier coupled between said multiplex output line and said analog-to-digital converter.

9. The apparatus of claim 1 wherein said wedge-shaped anodes detectors are each shaped like an isosceles triangle.

10. The apparatus of claim 1 wherein said wedge-shaped anode detectors are made from aluminum.

11. The apparatus of claim 1 wherein said sequencing means includes a data processor having means for sending control signals to said multiplexing means to vary said predetermined sequence.

12. The apparatus of claim 1 wherein said detectors are constructed on a silicon substrate and said multiplexing means is also constructed in said substrate.

13. An apparatus for image detection comprising:

a microchannel plate including two surfaces and a plurality of channels extending between said surfaces, said channels receiving and amplifying said incident energy;

a plurality of wedge-shaped anode detectors mounted in close proximity to one surface of said microchannel plate to receive amplified incident energy from said plate, each detector including a base portion and a vertex portion and being arranged along a first axis in an alternating sequence such that, except for the detectors at the end of said sequence, the vertex portion of any of said detectors is adjacent to the base portions of the two adjacent detectors, said wedge shaped anode detectors also each including an output terminal for presenting a detection signal representing the amount of said incident energy from said microchannel plate on the detector containing that terminal;

a multiplex output line;

means, coupled to each of said detector output terminals, for multiplexing said detection signals at said output terminals onto said multiplex output line; and sequencing means coupled to said multiplexing means for controlling said multiplexing means to present on said multiplex output line a data signal containing a predetermined sequence of said detection signals from selected ones of said detectors, said data signal containing information regarding the position of said incident energy.

* * * * *